United States Patent [19]

Fukuda et al.

[11] Patent Number: 4,819,302

[45] Date of Patent: Apr. 11, 1989

[54] SWINGINGLY MOVABLE CLEARER MECHANISM SUSPENDED FROM A DRAFT ROLLER

[75] Inventors: Tatemi Fukuda, Aichi; Yoshio Kawasaki, Fujieda; Masao Wakai, Shimada; Kenji Negishi, Fujieda; Isao Ono; Isao Arita, both of Hirakata, all of Japan

[73] Assignees: Kabushiki Kaisha Toyoda Jidoshokki Seisakusho; Kanpatsu Kogyo Kabushiki Kaisha, both of Hirakata, Japan

[21] Appl. No.: 158,588

[22] Filed: Feb. 22, 1988

[30] Foreign Application Priority Data

Mar. 24, 1987 [JP] Japan ..... 62-69400

[51] Int. Cl.[4] ..... D01H 5/62

[52] U.S. Cl. ..... 19/262; 19/264

[58] Field of Search ..... 19/245, 262, 264, 265

[56] References Cited

U.S. PATENT DOCUMENTS

| | | | |
|---|---|---|---|
| 901,784 | 10/1908 | Cordingley | 19/264 |
| 2,711,563 | 6/1955 | Lathauwer | 19/264 |
| 4,406,039 | 9/1983 | Hotz | 19/262 |
| 4,586,212 | 5/1986 | Gasser | 19/262 |

*Primary Examiner*—Louis K. Rimrodt

*Attorney, Agent, or Firm*—Oblon, Fisher, Spivak, McClelland & Maier

[57] ABSTRACT

A clearer mechanism for a draft roller, a clearer holder supporting a clearer member therein, and a suspensory member suspended from the draft roller and detachably supporting the clearer holder such that the clearer member is held against a working periphery of the draft roller. The mechanism further includes an actuating member or a restraining member projecting from either of the clearer holder and the suspensory member for displacing the actuating member or the restraining member to thereby reciprocally move the clearer holder along the working periphery of the draft roller.

9 Claims, 8 Drawing Sheets

SWINGINGLY MOVABLE CLEARER MECHANISM SUSPENDED FROM A DRAFT ROLLER

BACKGROUND OF THE INVENTION

1. Field of the Invention

The present invention relates to a clearer mechanism disposed in confrontation with a bottom draft roller assembly constituting a drafting unit of a spinning machine.

2. Prior Art

There is one known clearer mechanism comprising a plurality of clearer members made of a strip such as a leather, a synthetic leather, a natural or synthetic rubber and a laminated non-woven fabric, and a clearer holder supporting the clearer member such that one edge of the latter is held stationarily against a working peripheral surface of a draft roller for cleaning the same. This mechanism, however, has a drawback in that the clearer mechanism needs to be cleaned frequently since the clearer member tends to be worn out relatively easily and thus produces a clearer dust as the clearer member is continuously engaged by the rotating draft roller. With this drawback in view, consideration has been given to an actuator mechanism for intermittently disengaging the clearer member from the draft roller and to a mechanism for angularly moving the clearer holder so as to reciprocate the clearer member engaged by the draft roller. Actuation of these mechanisms needs additionally an independent drive means for moving a clearer-holder supporting bracket disposed on a roller stand. Provision of such an additional means makes the clearer mechanism as a whole to become complicated in construction, which is laborious in operation and time consuming in maintenance.

SUMMARY OF THE INVENTION

It is therefore an object of the present invention to provide a clearer mechanism of a relatively simple construction which is disposed in confrontation with the draft roller such that a clearer holder is reciprocated in a constant relative position with respect to the draft roller devoid of an independently actuating additional drive means, the reciprocation being actuated by the rotation of the roller.

A specific object of the present invention is to provide a clearer mechanism in which a clearer member is angularly and reciprocally movable along the periphery of a draft roller for raking a foreign material on the roller periphery including a clearer dust worn out from the clearer member and accumulated on the same.

According to the present invention, a clearer mechanism for a spinning machine comprises: a clearer member made of a soft sheet material; a clearer holder receiving therein said clearer member such that a distal end of the clearer member protrudes out of the clearer holder and is positively held against a peripheral surface of a draft roller of the machine; and a suspensory member being supported by the draft roller and suspended therefrom such that said suspensory member is reciprocally movable along the peripheral surface of the draft roller, said suspensory member detachably supporting said clearer holder such that the latter longitudinally confronts the draft roller.

Many other advantages, features and additional objects of the present invention will become manifest to those versed in the art upon making reference to the detailed description and the accompanying drawings in which preferred embodiments incorporating the principles of the present invention is shown by way of illustrative example.

DETAILED DESCRIPTION

Figure 1:
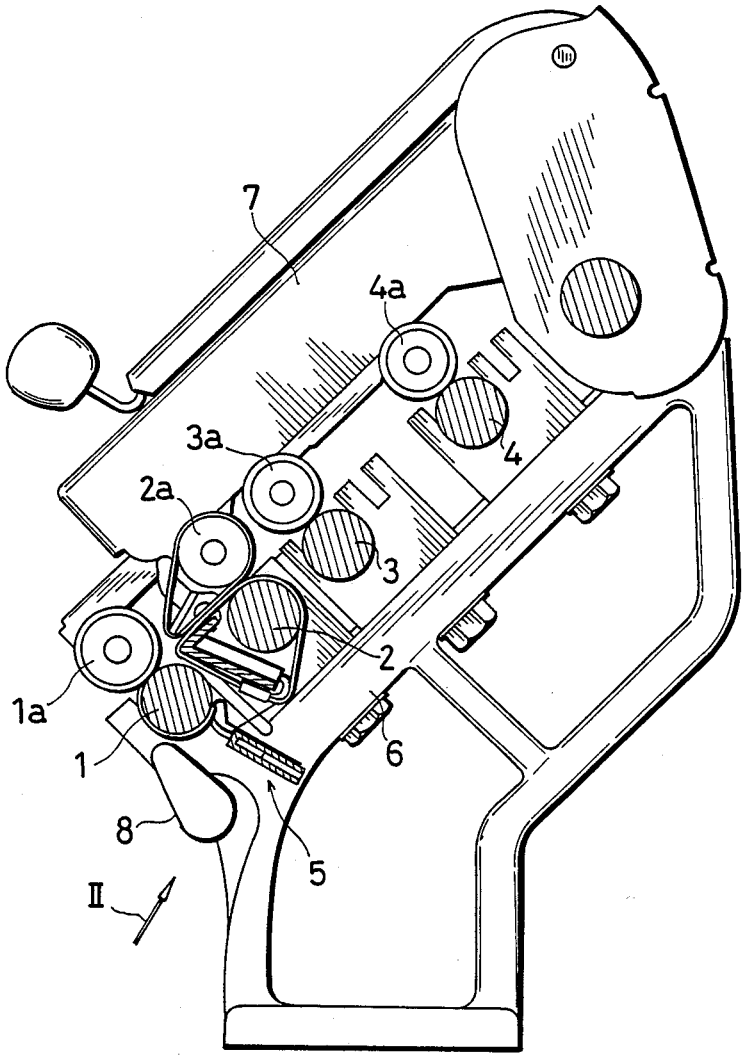
FIG. 1 is a cross-sectional side view of a clearer mechanism according to a first embodiment of the present invention incorporated in a front draft roller of a ring spinning machine.

FIG. 1 shows an angularly movable clearer mechanism 5 of a suspension type according to the present invention, in which a single unit of the mechanism is disposed in association with a drafting or elongation unit of a ring spinning machine. The clearer mechanism of the present invention may of course be incorporated in spinning machine of other types.

The drafting unit includes a series of bottom draft rollers, a front bottom draft roller 1, a bottom apron roller 2, a third bottom draft roller 3 and a back bottom draft roller 4 (all referred to as draft roller hereinbelow), and a series of top rollers, a front top roller 1*a*, a top apron roller 2*a*, a third top roller 3*a* and a back top roller 4*a* which are disposed above the draft rollers 1 to 4 and cooperate with the latter, respectively. The draft rollers are rotatably supported by a roller stand 6 while the top rollers are freely rotatably supported by a weighting arm 7 which urges the top rollers downwardly against the corresponding draft rollers. Designated by reference numeral 8 is a suction duct of a pneumatic clearer for sucking a dust collected by the clearer mechanism. A bottom apron unit incorporated in the second draft roller 2 is of a long apron type.

Figure 2:
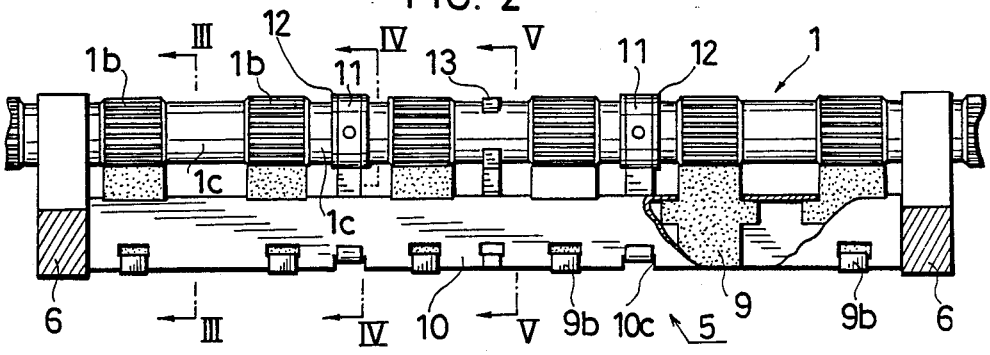
FIG. 2 is a fragmentary front elevational view as viewed in a direction of an arrow II.

FIG. 2 shows only one unit of the clearer mechanism 5 as viewed in the direction of an arrow A of FIG. 1 with the suction duct 8 omitted for clarification. The clearer mechanism 5 extends fully through a space or staff between an adjacent pair of roller stands 6 along the front or first draft roller 1. A plurality of the clearer mechanism units are disposed one at each staff of the drafting unit.

The draft roller 1 includes a plurality of longitudinally spaced flute portions 1b defining a working roller surface and roller shank portions 1c each disposed between adjacent pair of the flute portions 1b and having a diameter smaller than that of the flute portion 1b. Working surfaces of the top roller are held in engagement with the counterparts of the draft roller, and thus defining spaces jointly with the roller shank portions.

Figure 8:
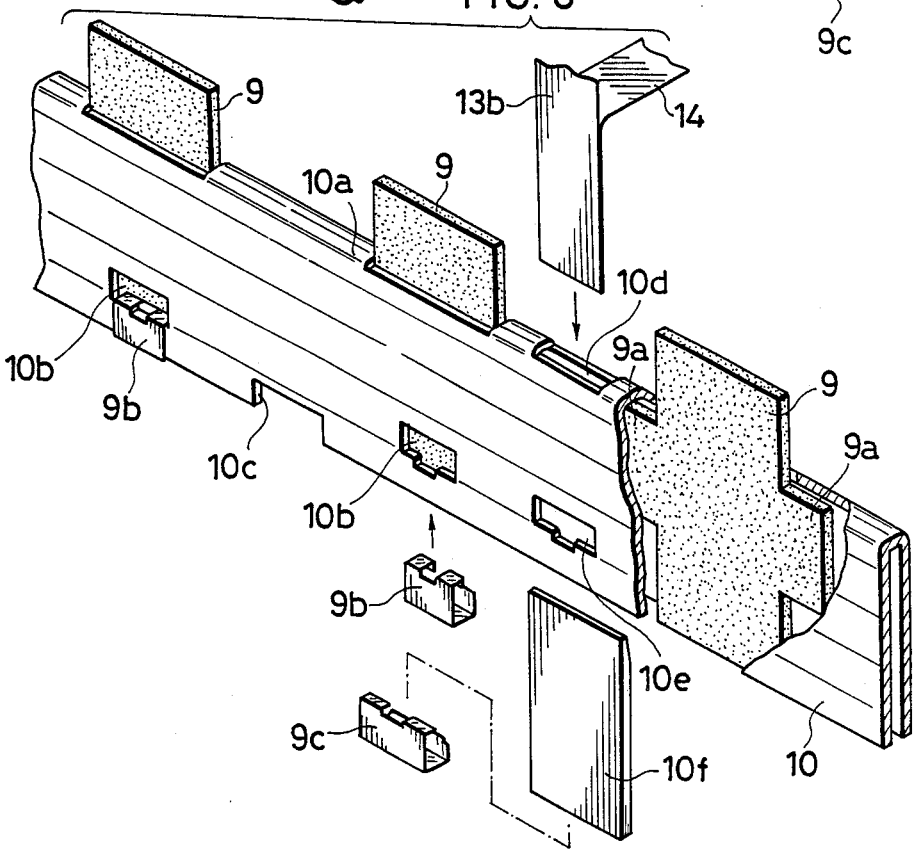
FIG. 8 is a perspective view of a clearer holder of the clearer mechanism of FIG. 1.

The clearer mechanism 5 includes a clearer holder 10 and a plurality of clearer members or elements 9 received in the latter. The clearer holder 10 supports clearer members 9 in registry with a plurality of weights (four to eight weights) disposed between the weights. The clearer holder 10 is formed by a folded rectangular metal sheet and has a plurality of slits 10a disposed on a folded elongate end of the clearer holder at an interval corresponding to the flute portions 1b. The clearer members 9 are inserted from a lower open end of the clearer holder 10 and project through the slits 10a as best shown in FIG. 8. The clearer member 9 has shoulders 9a at opposite lateral ends for restricting an extent to which a top end portion of the clearer member 9 projects out of the clearer holder 10 toward the flute portion 1b. A lower end of the clearer member 9 is flush with the lower open end of the clearer holder 10. A plurality of windows 10b are formed in one side wall of the clearer holder 10 and snap fasteners 9b are received in the windows with their hooks or curbed ends engaged by one edge of the windows and clamp the lower open end of the clearer holder 10 for thereby preventing the respective clearer members 9 from being detached from the holder 10.

Figure 3:
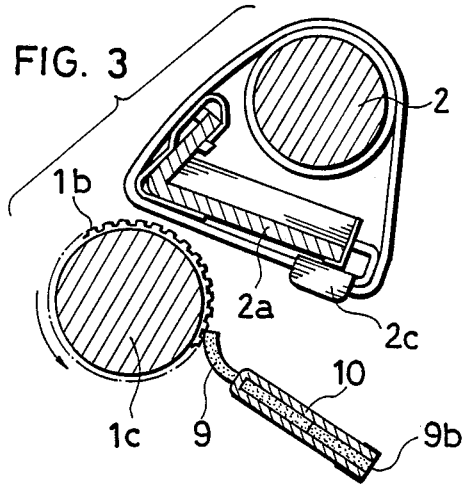
FIGS. 3, 4 and 5 are vertical cross-sectional views taken along lines III—III, IV—IV and V—V of FIG. 2.

As shown in FIG. 3, the clearer holder 10 is disposed such that a distal or free end of the clearer member 9 supported by the holder is held against the periphery of the flute portion 1b to be resiliently flexed. Specifically, a rear corner edge of the distal end of the clearer member is engaged by one of grooves on the periphery of the flute portion 1b for thereby cleaning the same.

The clearer mechanism 5 also includes a means for suspending the clearer holder 10 from the draft roller 1. In this particular embodiment, the suspending means includes a pair of suspensory members 11 suspended via a split bushes 12 in an angularly movable manner from two roller shank portions 1c, 1c located at opposite sides of the central roller shank portion 1c, as shown in FIG. 2.

Figure 4:
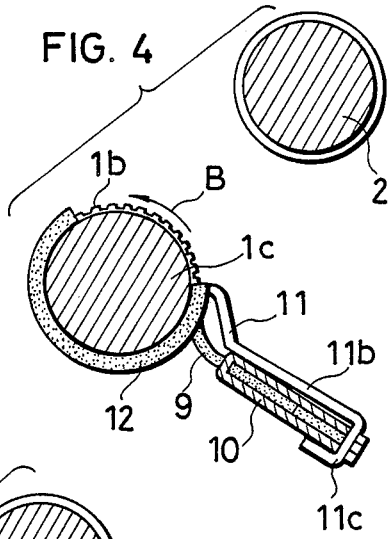
Figure 9:
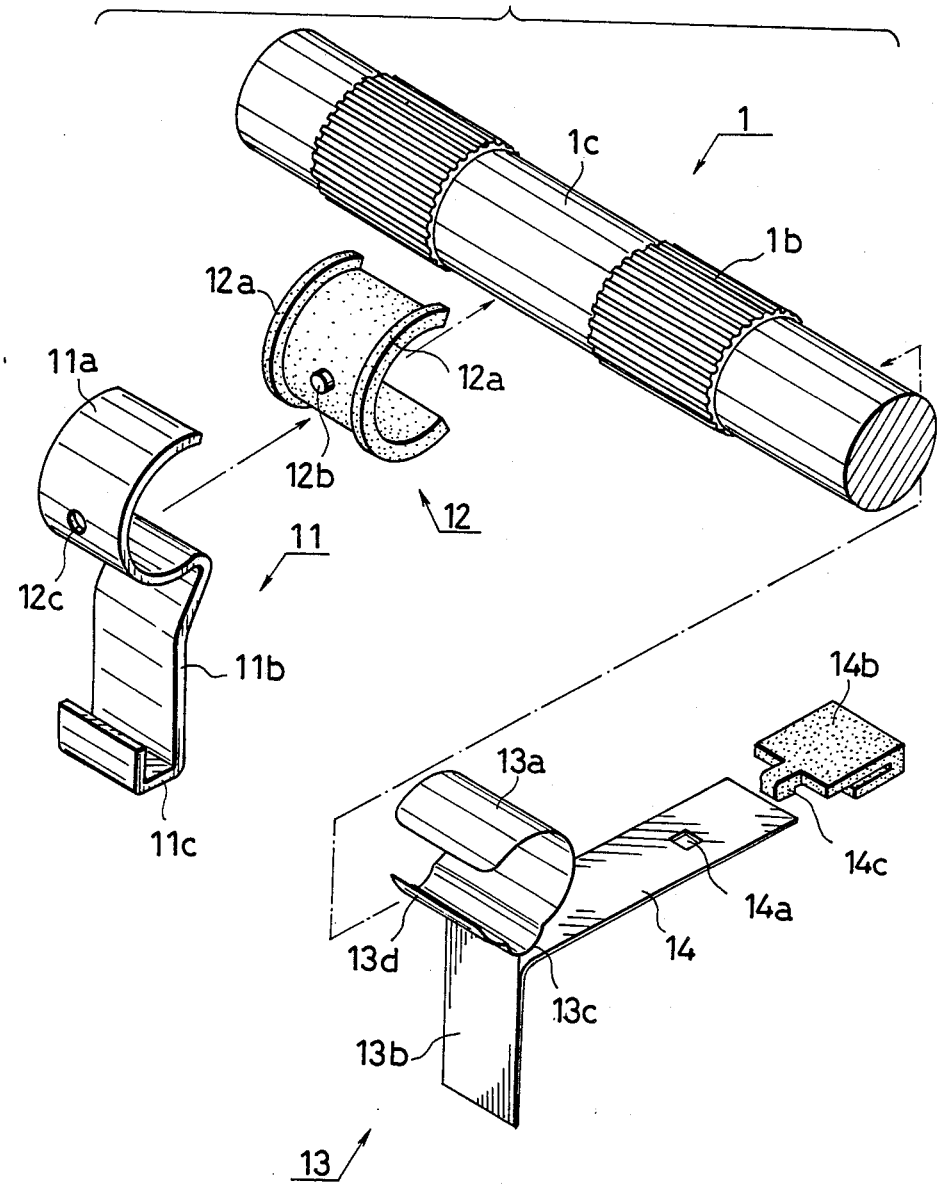
FIG. 9 is an exploded perspective view of primary components of the clearer mechanism.
Figure 20:
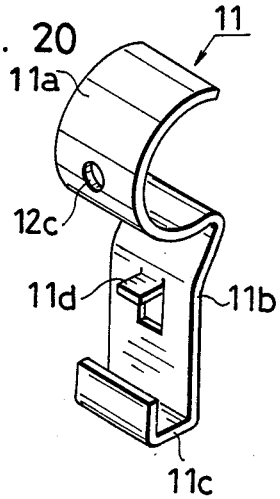
FIG. 20 is a modified suspensory member of the mechanism.

The suspensory member 11 includes a curbed grip portion 11a fitted around the split bush 12 which in turn is loosely fitted around the roller shank portion 1c as shown in FIGS. 4 and 9, and a bracket portion (11b and 11c) of a substantially J-shaped cross section extending downwardly from the latter for detachably retaining the clearer holder 10. The bracket portion includes a flat leg 11b connected at a upper end to the curbed portion 11a and a hook or foot 11c formed at its lower end. Preferably, a punched-out strip 11d is provided on the upper portion of the flat leg 11b for retaining securely the clearer holder 10 at its top end, as shown in FIG. 20.

The split bush 12 is formed of a split tubular body made of a synthetic resin and has opposite flanged ends 12a, 12a and a retaining lug 12b disposed substantially centrally of the periphery of the body. The bush 12 has an aperture defined at an angular portion of the body for enabling a snap-fit of the bush to the roller shank portion 1c of the draft roller. The bush is freely rotatable about the roller shank portion 1c in a fitted position. The suspensory member 11 is fitted on the bush 12 such that the curbed portion 11a is snugly fitted on the periphery of the bush body with its index bore 12c (FIG. 9) holding the retaining lug 12b.

To retain the clearer holder 10 in the suspensory member 11, two recesses 10c (FIG. 2 and 8) are formed at the lower open end of the clearer holder 10. The recess 10c has a width substantially equal to that of the foot 11c of the suspensory member 11 for snugly receiving the latter. More particularly, the clearer holder 10 is held stationarily both at an upper end of the back and a lower end of the face by the flat leg 11b and the foot 11c, respectively. With this arrangement, the clearer holder 10 prevents the clearer member 9 from being angularly counter-clockwise moved due to a moment of the clearer member caused by its frictional engagement of the clearer member 9 with the rotating surface of the draft roller which rotates in the direction of an arrow B of FIG. 4. As a result, the clearer holder 10 is subject to a bias force urging the same to angularly move counter-clockwise about the draft roller 1. When the clearer holder 10 and hence the suspensory member 11 are thus angularly moved to a certain extent, they are angularly moved back in the opposite or clockwise direction due to the gravity of the the holder and the suspensory member 11 as the latter exceeds the bias force. In the absence of the bias force given by the frictional engagement, the clearer holder 10 and the suspensory member 11 will be suspended from the draft roller in a vertical position in their gravity even when the draft roller 1 continues to rotates.

Alternatively, a single suspensory member of an increased width may be disposed intermediately of the draft roller 1. The position and number of the suspensory members P are not limited to those of the illustrated embodiment.

Figure 5:
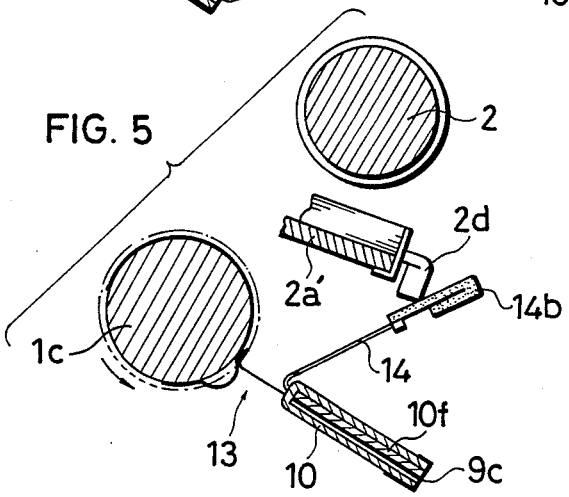

The clearer mechanism 5 further includes a drive means for positively moving the clearer holder 10 angularly. As shown in FIGS. 5 and 9, the drive means comprises an actuating member 13 and a restraining member 14 extending rearwardly therefrom, the actuating member and the restraining member being made of a resilient steel strip. The actuating member 13 includes a shackle portion 13a provided with an outwardly protruding semicircular portion 13c of a relatively small radius curvature and an abutment portion 13d formed at the lower end of the shackle portion, and a leg 13b extending downwardly from a rear end thereof connected to the shackle portion. The leg 13b is welded at its upper end to the rear end of the semicircular portion 13c. The shackle portion 13a is tightly fitted around the central one of the roller shank portions 1c (FIG. 2) with the abutment portion 13d held against the periphery of the latter under its resiliency. The leg 13b is connected to the clearer holder 10 as shown in FIG. 5. The restraining member 14 has a L-shape and is fixed at its frontal part to the leg 13b of the actuating member 13. The frontal part otherwise may be detachably secured to the clearer holder 10 together with the leg 13b of the actuating member 13. FIG. 8 shows an instance for the attachment, in which the leg 13b and the frontal part of the restraining member 14 are inserted together in the direction of an arrow into the clearer holder 10 through a slit 10d eon the top edge of the latter, and then a spacer 10f is inserted into the clearer holder 10 from its lower open end to thereby tightly secure the the leg 13b and hence the frontal part of the restraining member 14. A snap fastener 9c is fitted in a window 10e formed in the side wall of the clearer holder 10 in a manner similar to the snap fastener 9b in order to hinder the spacer 10f from dropping out of the clearer holder 10. The leg 13b and the frontal part may be secured to each other beforehand or otherwise inserted only in unison into the clearer holder 10.

The restraining member 14 is provided with an abutment strip 14b molded of a synthetic resin attached to a rear or free end of the restraining member. The abutment strip 14b has a groove for receiving therein the rear end of the restraining member 14, and a retaining lug 14c formed at its front end. The lug 14b is fitted in a retaining bore 14a formed in the web of the restraining member 14 to secure the latter to the abutment stuip 14b.

Figure 6:
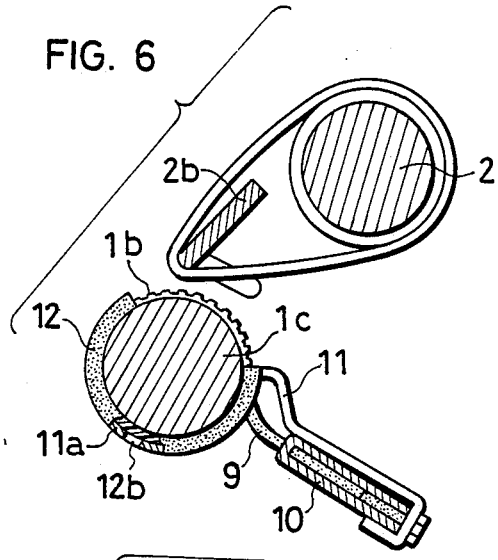
FIGS. 6 and 7 are cross-sectional side views similar to FIGS. 4 and 5, respectively, but showing a modified clearer mechanism.
Figure 7:
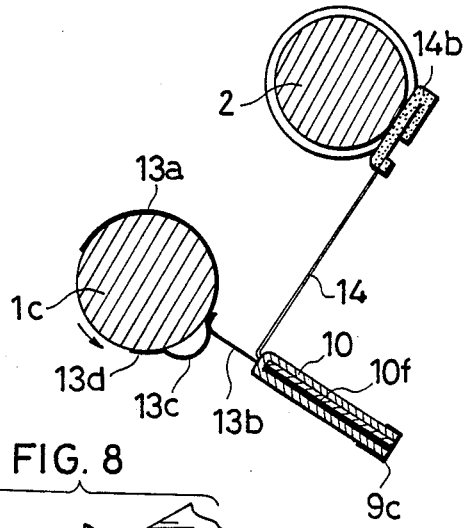

As shown in FIG. 5, the restraining member 14 has a length determined such that the abutment strip 14b is engageable with a nose 2d disposed on a lower end portion of a tension controller 2a'. In this instance of FIG. 5, the restraining member 14 is adapted to be used for the tension controller 2a' of the long bottom apron unit. FIGS. 6 and 7 show another application of the restraining member 14 for a short bottom apron unit having a short tension controller 2b, in which the restraining member 14 is long enough to hold the abutment strip 14b in engagement with a roller shank portion of the second draft roller 2 bedcause the short tension controller 2b is too short to be engaged by the abutment strip 14b.

In the above-described embodiment, the present clearer mechanism 5 is provided in cooperation with the front draft roller 1. Alternatively, the clearer mechanism 5 may cooperate with other draft rollers in the similar manner. In any case, the restraining member 14 should have such a length as it is engageable with the downstream draft roller and otherwise with a auxiliary abutment member if desired.

Figure 16:
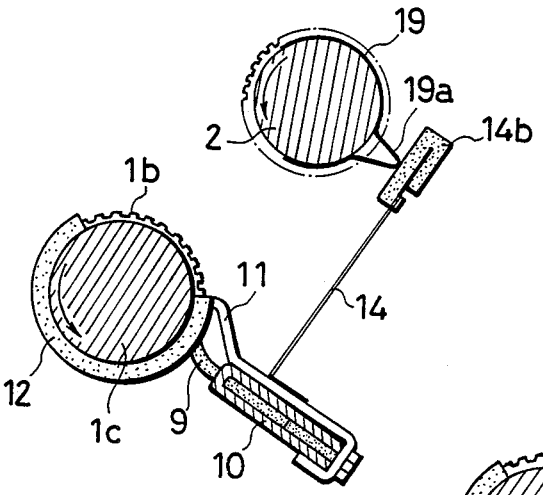
FIGS. 16 and 17 are cross-sectional side views of a third embodiment of the present invention.
Figure 17:
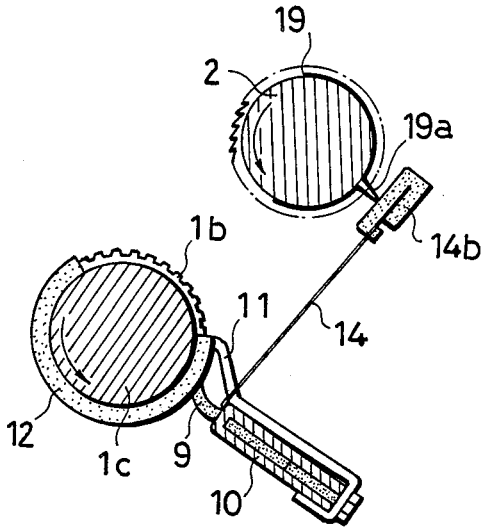

The drive means may comprise the restraining member 14 devoid of the actuating member 13 as shown in FIGS. 16 and 17. Instead of the actuating member 13, the drive means has a split ring 19 resiliently fitted around the roller shank portion of the second draft roller 2. In FIG. 16, the restraining member 14 extends in the direction of the angular movement from the back wall of the flat leg of suspensory member 11 suspended from the central roller shank portion 1c of the draft roller. The abutment strip 14b is held in engagement with the split ring 19 on the roller shank portion of the second draft roller 2. The ring 19 has a protrusion 19a which is engageable with the strip 14b for thereby shifting the restraining member 14. In FIG. 17, the restraining member 14 is connected to the clearer holder 10 and extends in the direction of the angular movement. The abutment strip 14b is also held against the protrusion 19a of the split ring 19 fitted around the roller shank portion of the second draft roller 2 in the similar manner with the restraining member 14 of FIG. 16.

Figure 18:
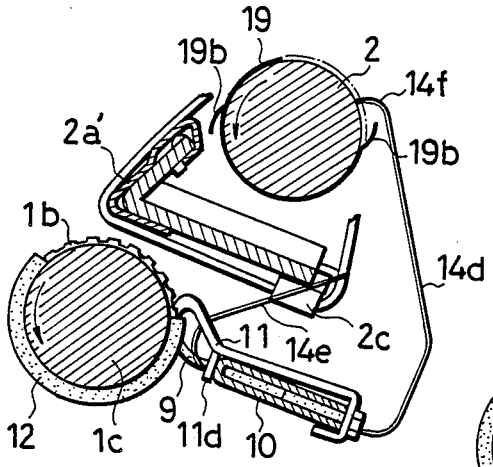
FIGS. 18 and 19 are cross-sectional side views of a fourth embodiment of the present invention.
Figure 19:
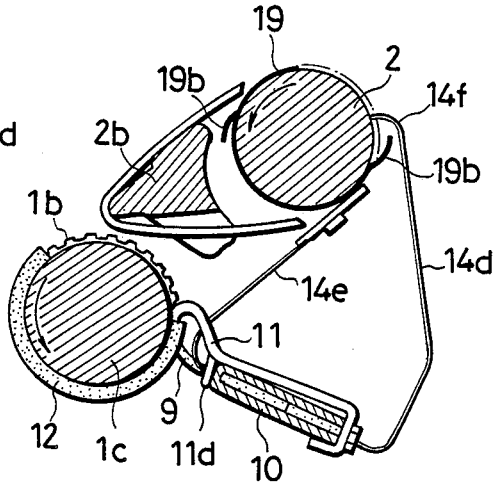

FIGS. 18 and 19 show modification of the restraining member 14, in which the restraining member 14 has an engagement part and an actuating part, both parts being made of a resilient steel strip.

In FIG. 18, the modified restraining member 14 is applied to the tension controller 2a' of the long bottom apron unit. The restraining member 14 extends through the clearer holder 10 by which the restraining member 14 is supported. The restraining member 14 has an engagement part 14e extending from the upper end of the clearer holder 10 for engagement with the lower end of the tension controller 2a' and an actuating part 14d extending from the lower end of the clearer holder 10 for engagement with the split ring 19 resiliently fitted around the second draft roller 2. The actuating part has an inwardly curved tongue 14f formed at its distal end. The tongue 14f is located at a position where it is engaged by one of projections 19b formed on the periphery of the split ring 19 as the latter rotates with the draft roller 2.

FIG. 19 shows another modified restraining member 14 applied to the short bottom apron unit, in which both of the actuating and engagement parts 14f, 14e are engageable with the split ring 19 fitted on the roller shank portion of the second draft roller 2. In the embodiment of FIGS. 18 and 19, the split ring 19 has two projections 19b, 19b, and the suspensory member 11 has a punched-out tab 11d to secure the clearer holder 10 thereto.

The drive means of the clearer mechanism 5 according to the present invention operates as described hereinbelow.

Figure 10:
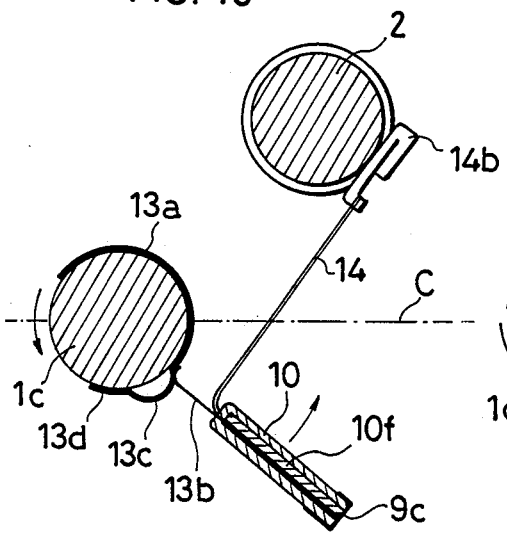
FIGS. 10 and 11 are cross-sectional views showing a manner in which the clearer mechanism is operated.
Figure 11:
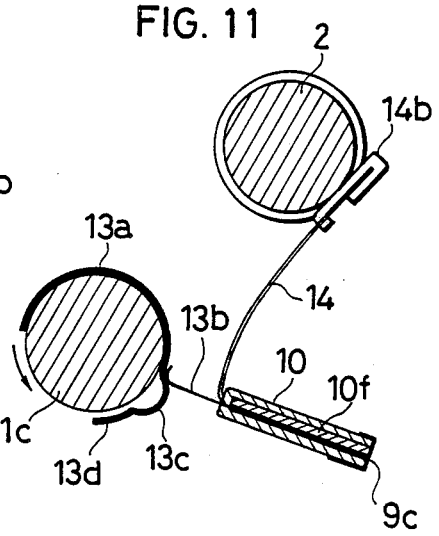

FIGS. 10 and 11 show the manner in which the clearer mechanism 5 is driven by the drive means of FIG. 7. As shown in FIG. 10, the shackle portion 13a of the actuating member 13 is frictionally engaged by the roller shank portion 1c of the draft roller. Rotation of the draft roller 1 in the direction of the arrow causes the shackle portion 13a to rotate therewith, thereby angularly moving the clearer holder 10 in the direction of the arrow until the clearer holder 10 is tilted at an angle of approximately 30 degrees with respect to a horizontal line C passing the axis of the draft roller 1. At this time, the abutment strip 14b of the restraining member 14 is engaged by the second draft roller or bottom apron roller 2 (FIG. 10). With the continued rotation of draft roller 1, the shackle portion 13a is rotated to tilt further the leg 13b and hence the clearer holder 10, and thus flexibly bends the restraining member 14 (FIG. 11), whereupon the abutment portion 13d is forced to be disengaged from the periphery of the roller shank portion 1c. This is because the leg 13b of the suspensory member 11 is fixedly connected to the rear end of the semicircular portion 13c and acts as a lever to pivotally move the semicircular portion 13c and the abutment portion 13d when the leg 13b is angulaly moved rearwardly. The disengagment of the abutment portion 13d from the roller shank portion 1c loosens and thus decreases the frictional engagement of the shackle portion 13a with the roller shank portion 1c of the draft roller 1, with the result that the clearer holder 10 is returned to a position of FIG. 10 or a further downward position due to the resiliency or restoring force of the restraining member 14 and the gravity of the clearer holder 10. These actions are repeated as the draft roller rotates, and thus the clearer holder 10 and clearer member 9 are reciprocally moved along the periphery of the draft roller 1.

In the drive means of FIGS. 16 and 17, the protrusion 19a engages the abutment strip 14b as the draft roller 2 rotates in the direction of an arrow, whereupon the abutment strip 14b is shifted away from the second draft roller 2, thereby angularly moving the clearer holder 10. Amount of the movement of the clearer holder 10 can be controlled by adjusting a height of the protrusion 19a. To increase the number of movement thereof, additional protrusions 19a are provided on the split ring 19.

In FIGS. 18 and 19, one of the projections 19*b* on the split ring 19 engages the curved tongue 19*f* as the second draft roller 2 rotates, whereupon the actuating part 14*d* is pulled upwardly counterclockwise (FIG. 18) from the illustrated initial position and resiliently deformed for thereby angularly moving the clearer holder 10 also counterclockwise, with the engagement part 14*e* held against the tension controller 2*a'* (FIG. 18) or the second draft roller 2 (FIG. 19) via the split ring 19. Further rotation of the second draft roller 2 causes the curved tongue 14*f* to be released from the projection 19*b*, and then the tongue 14*f* spring back to its initial position illustrated in the drawing. With this pull-and-release action of the drive means, the clearer holder 10 and hence the clearer member 9 are reciprocally moved along the periphery of the draft roller 1 for thereby cleaning the same. In FIG. 19, the release of the curbed tongue 14*f* from the preceding projection 19*b* by which the tongue is hooked is assisted by the engagement part 14*e* when the latter is engaged by the succeeding projection 19*b* and shifted away from the draft roller 2.

Figure 12:
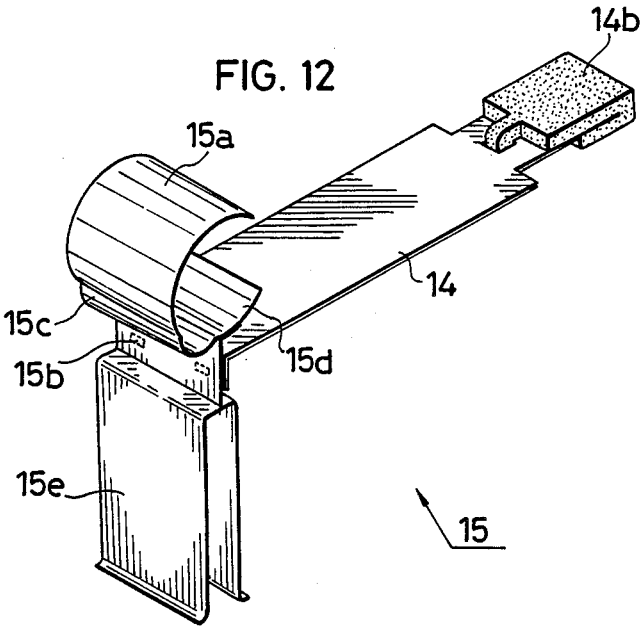
FIG. 12 is a perspective view of a modified actuator member.

FIG. 12 shows a modified actuating member 15 which similar to the actuating member 13 except that the actuating member 15 has a clamper 15*e* instead of the flat leg 13*b*. The clamper 15*e* is in the form of a bifurcated leg portions for resiliently clamping the clearer holder 10 therebetween. The actuating member 15 further has a shackle portion 15*a*, a semicircular portion 15*c* connected at the rear end to the lower end of the latter, an abutment portion 15*d* extending from the front end of the semicircular portion, and a short leg 15*b* fixed to the front end (but not the rear end) of the semicircular portion, the clamper extending from the short leg. This arrangement is convenient in that it allows the restraining member to be joined with the clearer holder 10 beforehand when the clearer holder 10 is mounted in the suspensory membery member.

Figure 13:
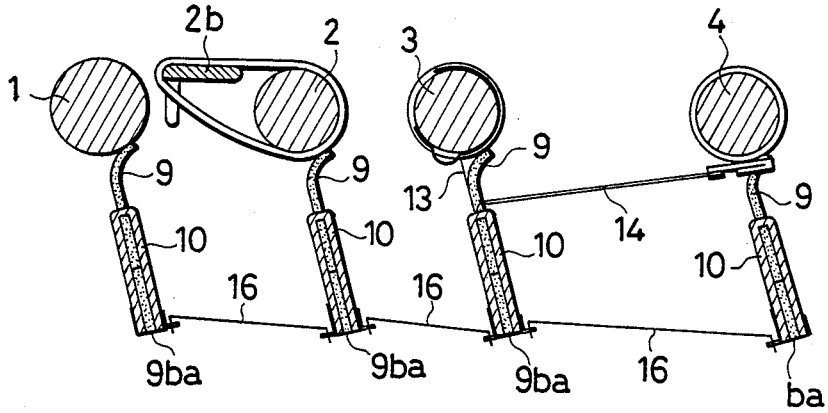
FIGS. 13 and 14 are cross-sectional side views of a second embodiment of the present invention.

FIG. 13 shows a clearer mechanism according to other embodiment of the present invention, in which all the draft rollers are provided with clearer units which are suspended from the respective draft rollers. The clearer units (9 and 10) are operatively connected to each other by links as described hereinbelow and are driven by a single drive means provided 5 on one of the clearer unit. More particularly, the clearer holders 10 are suspended from each of the first to fourth draft rollers 1, 2, 3 and 4. The actuating member 13 is mounted on the third draft roller 3 while the restraining member 14 is held against the fourth draft roller 4. The adjacent pairs of clearer holders 10 are connected to each other by connecting rods 16. More particularly, the connecting rod 16 has opposite bent ends each received in a bore formed in a tab 9*ab* extending from the snap fastener 9*b* (FIG. 8). Instead of the tab 9*ab* formed on the snap fastener 9*b*, a bored strip may be attached to the bottom face of the snap fastener 9*b* or directly to the lower open end of the clearer holder 10.

Figure 14:
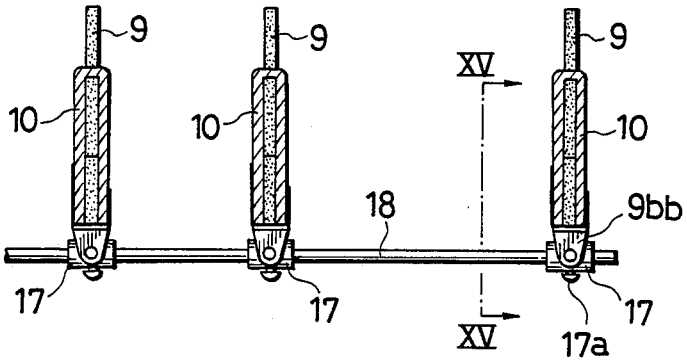
Figure 15:
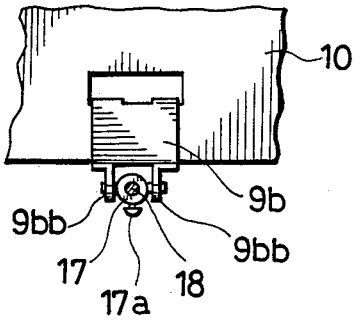
FIG. 15 is a vertical cross-sectional view taken along long line XV—XV of FIG. 14.

As shown in FIG. 14, a single connecting bar 18 may be used in place of the plurality of the connecting rods 16. A pair of spaced guide walls 9*bb*, 9*bb* are disposed on the bottom surface of each snap fastener 9*b* attached to the lower open end of the clearer holder 10, and a tubular guide 17 is pivotally supported by the pair of guide walls 9*bb* via a pair of pins projecting oppositely from the tubular guide 17. The connecting bar is past through a series of tubular guides 17 supported on the respective clearer holders 10 below the draft rollers 1 to 4. The connecting bar 18 is secured to the tubular guides 17 by screws 17*a* such that the respective clearer holders 10 are held in an inclined position. One of the clearer holders 10 is driven to angularly move for thereby secondarily moving the other clearer holders 10. The guide wall 9*bb* may be formed by a tab punched out and raised from the snap fastener 9*ba*, or otherwise formed by a separate piece.

With the arrangement described hereinabove, the clearer mechanism according to the present invention is disposed in a predetermined opposing relation with each of the draft rollers, and is reciprocally moved by a drive means of a very simple construction for exerting the cleaning of the draft roller with utmost efficiency. When the front corner edge of the clearer member is worn out, the face direction of the clearer holder 10 is changed so as to orientate its back toward the upstream direction to utilize the rear corner edge of the clearer member 9. At the same time, the actuating member and the restraining member are remounted so as to extend properly.

The clearer mechanism is also advantageous in that the drive means utilizes the rotation of the draft roller, thus making it unnecessary to provide an additional drive source which makes the construction of the mechanism as a whole complicated and needs a tedious maintenance. The simple construction of the mechanism is also advantageous in view of the construction cost.

Although various minor modifications may be suggested by those versed in the art, it should be understood that I wish to embody the scope of the patent warranted hereon, all such embodiments as reasonably and properly come within the scope of my contribution to the art.

What is claimed is:

1. A clearer mechanism for a draft roller comprising:

a clearer member made of a soft sheet material;

a clearer holder receiving therein said clearer member such that a distal end of the clearer member protrudes out of the clearer holder and is positively held against a peripheral surface of a draft roller of the machine; and a suspensory member being supported by the draft roller and suspended therefrom such that said suspensory member is swingingly movable along the peripheral surface of the draft roller, said suspensory member detachably supporting said clearer holder such that the latter longitudinally confronts the draft roller.

2. A clearer mechanism according to claim 1, said suspensory member having a curved portion adapted to be rotatably fitted around a shank portion of the draft roller via a bush rotatably fitted around the latter such that said suspensory member is swingingly movable about an the bush and the draft roller, and further having a bracket of a substantially J-shaped cross section for detachably holding said clearer holder.

3. A clearer mechanism according to either of claim 1 or claim 2, further including and actuating member extending from said suspensory member or from said clearer holder toward the draft roller having an arcuate bracket disposed at one end thereof for compressively clamping the draft roller shank portion, and a restraining member fixedly connected to an intermediate portion of said actuating member and having a portion engageable with a desired stationnary part such that said restraining member restricts a forward swinging movement of said clearer holder caused by rotation of the draft roller, and that said engagement of said restraining member causes a portion of said arcuate bracket to be disengaged from the draft roller to thereby decrease the clamping force of said arcuate bracket, thus allowing said clearer holder to backward of swinging movement.

4. A clearer mechanism according to either of claim 1 or claim 2, including a restraining member extending from said suspensory member or said clearer holder in the forward direction of said swinging movement of the suspensory member or the clearer holder, and a restraining member for positively moving said restraining member to thereby move said clearer holder reciprocally.

5. A clearer mechanism according to claim 4, said restraining member including an annular strip fitted around a shank portion of another draft roller, said annular strip having a projection disposed on its periphery, said projection being engageable with a distal end of said restraining member such that the distal end of said restraining member is moved intermittently away from said annular strip on said another draft roller, as said annular strip rotates together with said another draft roller, for thereby reciprocally moving said clearer holder to which said restraining member is fixedly connected.

6. A clearer mechanism according to claim 4, said restraining member including an annular strip fitted around a shank portion of another draft roller, said annular strip having one or more raised portions disposed on its periphery, said restraining member including a restraining portion held in engagement with a desired stationary part of the spinning machine and an actuator portion, said raised portions being engageable with a distal end of said actuator portion such that the distal end is moved against and away from said annular strip on said another draft roller, as said annular strip rotates together with said another draft roller, for thereby reciprocally moving said clearer holder.

7. A clearer mechanism according to claim 6, said restraining portion having a distal end held in engagement with said annular strip such that engagement of the lastmentioned distal end with one of said raised portions on the annular strip causes said clearer holder to move backward and also to disengage said actuator portion from the raised portion.

8. A clearer mechanism according to either of claim 1 or claim 2, further including additional clearer holders, said clearer holder and said additional clearer holders being operatively connected in succession by a plurality of links such that all said clearer holders are reciprocally movable in unison.

9. A clearer mechanism according to either of claim 1 or claim 2, further including additional clearer holders, said clearer holder and said additional clearer holders being operatively connected in succession by a connector rod such that all said clearer holders are reciprocally movable in unison.

* * * * *